US009624083B2

(12) United States Patent
Tuggle et al.

(10) Patent No.: US 9,624,083 B2
(45) Date of Patent: Apr. 18, 2017

(54) HANDS-FREE HYDRATION FOR ADULTS AND THE DISABLED

(71) Applicant: Carolina Buyer's Agent, Charlotte, NC (US)

(72) Inventors: Julie Tuggle, Charlotte, NC (US); Marvin Wheaton, Augusta, GA (US); John Woodard, Greer, SC (US)

(73) Assignee: Carolina Buyer's Agent, Charlotte, NC (US)

( * ) Notice: Subject to any disclaimer, the term of this patent is extended or adjusted under 35 U.S.C. 154(b) by 0 days.

(21) Appl. No.: 14/097,807

(22) Filed: Dec. 5, 2013

(65) Prior Publication Data

US 2016/0029823 A1 Feb. 4, 2016

(51) Int. Cl.

*B67D 7/80* (2010.01)
*B67D 1/00* (2006.01)
*B67D 1/08* (2006.01)

(52) U.S. Cl.

CPC ..... *B67D 1/0004* (2013.01); *B67D 1/0081* (2013.01); *B67D 1/0857* (2013.01); *B67D 2210/00133* (2013.01)

(58) Field of Classification Search

CPC ..... B67D 1/10; B67D 1/0081; B67D 1/0801; B67D 1/0857; A47G 19/2266; A47G 19/2288; A47J 47/01

USPC ..... 222/146.6; 220/703, 705, 709, 710; 224/148.2

See application file for complete search history.

(56) References Cited

U.S. PATENT DOCUMENTS 2,725,725 A * 12/1955 Materese ..... B67D 3/0009 62/391
5,607,087 A * 3/1997 Wery ..... B67D 1/0456 222/401
5,645,404 A * 7/1997 Zelenak ..... A45F 3/16 222/175
5,921,445 A * 7/1999 Schmitz ..... B67D 1/0004 222/173
6,062,435 A * 5/2000 Hess, III ..... B65D 75/5883 222/175
6,755,047 B2 * 6/2004 Kreutzmann ..... A42B 3/048 62/400
7,007,502 B2 * 3/2006 Kreutzmann ..... A42B 3/048 62/457.2
8,220,664 B1 * 7/2012 Teetzel ..... A45F 3/20 222/175
8,460,234 B1 * 6/2013 Duron-Smith ..... A47G 19/2266 604/77
8,893,984 B2 * 11/2014 Sands ..... B05B 3/022 239/288
2004/0045980 A1 * 3/2004 Robins ..... A45F 3/16 222/63
2006/0086821 A1 * 4/2006 Junkel ..... A45F 3/16 239/302

* cited by examiner

*Primary Examiner* — Lien Ngo

(57) ABSTRACT

Embodiments of the invention relate to an apparatus for providing hands-free hydration to a person. Specifically, the invention comprises a case having a storage container with chilled fluid therein and a pump for circulating the chilled fluid. Additionally, the device further comprises several lines of tube for supplying water to a user when the user engages a bite valve.

4 Claims, 2 Drawing Sheets

HANDS-FREE HYDRATION FOR ADULTS AND THE DISABLED

BACKGROUND

Dehydration is one of the ten most frequent diagnoses responsible for hospitalization of adults in the US age 65 or older and has also been associated with memory impairment, falling, daytime fatigue, and urinary tract infections. Older adults experience a declined level in total body water content, so smaller losses of body water can cause dehydration. To compound the problem, older adults do not drink enough fluid because they do not feel thirsty, and kidneys are less able to retain water. And 25% of all adults over the age of 65 have difficulty walking, so many lack the strength and coordination to pour themselves a drink when they are thirsty. Thus, a need exists for a device that enables older adults and the disabled to independently get a drink of chilled water without depending on others for assistance.

SUMMARY

Embodiments of the present invention provide a convenient means for elderly and disabled individuals to independently access a chilled and filtered fluid source for a drink without assistance. The invention is designed to meet the needs of the disabled and older users with limited dexterity and/or mobility better than conventional fluid dispensers.

Embodiments of the present invention provide an device configured to deliver fluid to a user, the device comprising: a recirculation pump connected to fluid supply and return tubes configured to continuously circulate chilled fluid, the fluid supply and return tubes encased inside a semi-rigid tubing sleeve that can be adjusted to position the fluid supply tube; and a drinking valve operatively connected to the end of the fluid supply tube.

Embodiments of the present invention provide a clip or other hardware to secure the semi-rigid tubing sleeve into fixed, convenient position for the user to access.

Embodiments of the present invention provide a check valve that is operatively connected behind the drinking valve, such that fluid that reaches the drinking valve does not flow backward through the "Y" connector and into the return tube.

Embodiments of the present invention provide that the drinking valve is a bite valve, such that the chilled fluid is released into the user's mouth when the user compresses the drinking valve.

Embodiments of the present invention provide a device case with an external fluid source container that is located on top of the device case, the device case providing connectors to a supply tube and a return tube; a chilled fluid storage tank to hold and keep the fluid from the source container chilled; an interior fluid supply and return tube connected to the chilled fluid storage tank; a drinking valve located at the distal end of the fluid supply tube, the drinking valve configured as a bite valve to release chilled fluid to a user when the user compresses the drinking valve; an exterior semi-rigid tubing sleeve encasing the fluid supply and return tubes; a recirculation pump operatively connected to the interior fluid supply tube, the recirculation pump configured to circulate the chilled fluid through the exterior fluid supply tube, away from the chilled fluid storage tank and back down to the chilled fluid storage tank through the exterior fluid return tube so that the fluid continuously circulates through the device.

Embodiments of the present invention provide for a filter that is operatively connected to city or private plumbing lines such that contaminants are filtered out of the fluid.

Embodiments of the present invention provide for a tap onto existing city or private plumbing lines as the source of the fluid to be stored in the chilled fluid storage tank.

The features, functions, and advantages that have been discussed may be achieved independently in various embodiments of the present invention or may be combined in yet other embodiments, further details of which can be seen with reference so the following description and drawings but are not limited to only these applications shown.

DETAILED DESCRIPTION OF EMBODIMENTS OF THE INVENTION

Embodiments of the present invention now will be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. In the following description, for purposes of explanation, numerous specific details are set forth in order to provide a thorough understanding of one or more embodiments. However, it may be evident that such embodiment(s) may be practiced without these specific details. Like numbers refer to like elements throughout.

Throughout the specification, the terms "tube" and "tubing" are used to name and describe structures in the device. The terms "tube" and "tubing" can mean any fluid conduit structure or system capable of transporting fluid. Such structures may be channels, hoses, pipes, or the like.

Throughout the specification, the term "semi-rigid" is used to name and describe structures in the device. As used in this application, a "semi-rigid" object is an object which is bendable or adjustable and simultaneously sturdy enough to hold its position when no bending or adjusting forces are applied to the object. The semi-rigid object may be composed of a single semi-rigid material or composed of both flexible and non-flexible material. Examples of semi-rigid objects are bendable straws (accordion design), bendable cables, aluminum foil, and the like.

Figure 1:
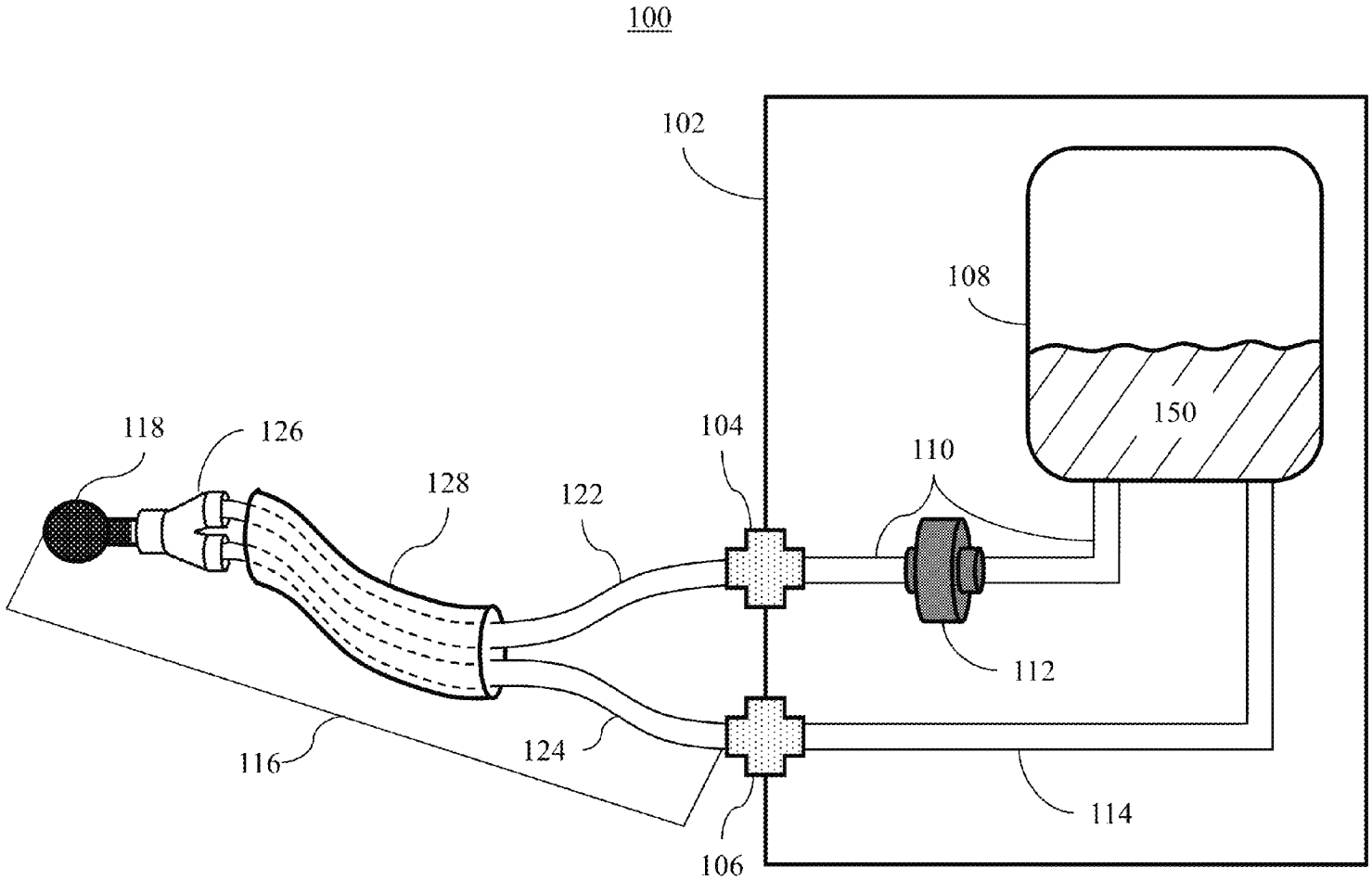
FIG. 1 provides a perspective view of an device for providing personal hydration, according to an embodiment of the present invention.

Referring to the drawings, FIG. 1 illustrates the device 100 configured for providing a source of hands-free hydration. The device 100 includes a device case 102 containing a chilled fluid storage tank 108, an interior fluid supply tube 110, interior fluid return tube 114, and a fluid recirculation pump 112. The device case 102 may be made of one or more types of material. Embodiments of the invention may provide one or more supply tube connectors 104 to connect the exterior and interior supply tubes to the device case 102. Similarly, embodiments of the invention may provide one or more return tube connectors 106 to connect the exterior and interior supply tubes to the device case 102.

Embodiments of the invention provide one or more openings in the device case 102 such that one or more supply tubes may pass through the device case 102 to connect the fluid recirculation pump 112 to the "Y" connection 126 and to the chilled fluid storage tank 108. Embodiments of the invention provide one or more openings in the device case 102 such that one or more return tubes may pass through the device case 102 to connect the fluid recirculation pump 112 to the "Y" connector 126 and to the chilled fluid storage tank 108.

Embodiments of the invention provide a chilled fluid storage tank 108 that is operatively connected with the device case 102. The chilled fluid storage tank 108 stores a fluid 150 to be moved about the device 100. Embodiments of the invention provide that the fluid storage tank 108 is operatively connected with a fluid cooling system such that the fluid 150 in the fluid storage tank 108 may be cooled.

Some embodiments of the invention provide that the fluid 150 is provided to the chilled fluid storage tank 108 by a replaceable fluid container. In other embodiments of the invention, the fluid 150 is provided to the fluid storage tank 108 by a tap line, as such the device 100 is a tankless and/or bottleless device. In some embodiments, a filter is operatively connected between the fluid storage tank 108 and the tap line such that the fluid 150 is filtered before it enters the chilled fluid storage tank.

An interior fluid supply tube 110 connects the fluid storage tank 108 to the supply tube connector 104. The interior fluid supply tube 110 may be flexible, rigid, semi-rigid, or a combination of these characteristics. Embodiments of the present invention provide that a fluid recirculation pump 112 is operatively connected to the interior fluid supply tube 110. The fluid recirculation pump 112 places a force on the fluid 150 to cause the fluid 150 to flow away from the chilled fluid storage tank 108, along the interior fluid supply tube 110. The fluid recirculation pump 112 may use any method of fluid propulsion capable of causing fluid flow, such as a rotary pump, a gear pump, a peristaltic pump, a centrifugal pump, and the like. Embodiments of the present invention provide that gravity is the force that causes the fluid 150 to flow from the fluid storage tank 108 to the fluid recirculation pump 112. In other embodiments of the invention, the fluid recirculation pump 112 operates as suction such that the fluid 150 is pulled from the fluid storage tank 108, along the interior fluid supply tube 110, and into the fluid recirculation pump 112. In some embodiments, fluid circulation pump 112 periodically (e.g., every 3-10 minutes) and without human intervention automatically forces chilled fluid from the fluid storage tank 108 to flow into exterior supply tube in order to cause the fluid resting in the fluid supply line to return to the fluid storage tank 108. In this way, the device recycles the fluid resting in the return and supply tubes and replaces the fluid that was resting in the return and supply tubes with chilled fluid. To this point, a user of the device should constantly have chilled water in the supply line.

Also within the device case 102, an interior fluid return tube 114 connects from the return tube connector 106 to the chilled fluid storage tank 108. The interior fluid return tube 114 may be flexible, rigid, semi-rigid, or a combination of these characteristics, and allows the fluid 150 to flow toward the chilled fluid storage tank 108. In some embodiments of the invention, the interior fluid return tube 114 may connect from return tube connector 106 to a section of the interior fluid supply tube 110 between the chilled fluid storage tank 108 and the fluid recirculation pump 112.

Outside of the device case 102, the fluid supply tube 122 is connected at the proximal end to the supply tube connector 104, and the fluid return tube is connected at the proximal end to the return tube connector 106. As embodied in FIG. 1, the fluid supply tube 122, the fluid return tube 124, and the "Y" connector 126 are encased inside the semi-rigid tubing sleeve 128. The drinking valve 118 is located at the distal end of the fluid supply tube on the other side of the "Y" connector 126. The drinking valve 118 may be any type of valve or other dispenser unit capable of delivering the fluid 150 when activated by the user, such as a bite valve, a spout with a handle, a valved straw, or the like. The present embodiment of the invention provides drinking valve that is a bite valve with a check valve behind the bite valve such that fluid 150 that enters the drinking valve 118 is prevented from getting back into the return tube at the "Y" connector 126. In some embodiments, upon engaging the bite valve by a user, the engaging automatically triggers the fluid recirculation pump 112 to activate, so that the fluid recirculation pump 112 may forceably move fluid throughout the device via the supply and return tubes in order to maintain a constant amount of fluid and pressure within the supply and return tubes of the device.

The fluid supply tube 122 connects from the supply tube connector 104 at the proximal end of the fluid supply tube 122 to the "Y" connector 126 at the distal end of the fluid supply tube 122. The fluid supply tube 122 may be flexible or semi-rigid and provides a channel for the fluid 150 to flow between the supply tube connector 104 and the "Y" connector 126. Similarly, the fluid return tube 124 which connects the "Y" connector 126 at the proximal end of the fluid return tube 124 to the return tube connector 106 at the distal end of the fluid return tube 124. The fluid return tube 124 may be flexible or semi-rigid and provides a channel for the fluid 150 to flow between the "Y" connector 126 and the return tube connector 106.

The "Y" connector 126 is operatively connected to the fluid supply tube 122 and the fluid return tube 124 such that the fluid 150 may flow to and from each of those components. In one embodiment of the invention, the fluid supply tube 122, the drinking valve 118, and the fluid return tube 124 are created from the same mold and no connector such as "Y" connector 126 is required.

The tubing sleeve 128 encases the fluid supply tube 122 and the fluid return tube 124. The tubing sleeve 128 is semi-rigid such that the tubing sleeve 128 is flexible enough to bend in any direction, yet sturdy enough to remain fixed in place once bent. Embodiments of the present invention provide for a clamp or other connecting hardware that attaches the tubing sleeve 128 such that the tubing sleeve 128 is secured to a stationary object and therefore the tubing sleeve 128 has an anchor point from which to be positioned. In some embodiments of the invention, the fluid supply tube 122 and the fluid return tube 124 are semi-rigid and no tubing sleeve 128 is required.

FIG. 1 illustrates that the device 100 is characterized in that the fluid 150 may be circulated through the components of the device 100 by means of the fluid recirculation pump 112. Embodiments of the present invention involve a chilled fluid tank 108, the circulation of the fluid 150 allows for a constant supply of chilled fluid 150 to be pumped to the drinking valve 118 such that the chilled fluid 150 is recirculated before the temperature of the fluid 150 rises to room temperature. Such an embodiment is a unique advantage to users who desire to take smaller sips of chilled fluid throughout the day without assistance. The temperature of a cooled fluid in a non-circulating fluid supply system would rise to room temperature if left in a supply tube for an extended period of time, losing the chilled fluid characteristic desired by the user without depending on others for assistance.

In some embodiments of the invention, the fluid 150 is a mixture of a liquid substance and small solid particles such as drugs, dietary supplements, or additives for flavor or color. In such an embodiment, the circulation of the fluid 150 allows for a constant flow and mixing of the fluid 150 such that the solid particles do not settle or aggregate. Such an embodiment is greatly beneficial to users 120 who desire small sips of a fluid mixed with additional supplements throughout the day. The solid particles of a fluid mixture with liquid and solid components could settle and change the fluid dilution of the fluid 150 in a non-circulating fluid supply system.

In some embodiments of the invention, one or more shut-off valves may be operatively connected to tubing junctions 104 and 106.

Embodiments of the present invention provide for alternate methods of fluid supply such as a spigot with a handle, a non-circulatory hose, and the like. These alternate interior supply tubes may deliver fluid to the alternate fluid supply junctions by means of gravity or a pumping device like the fluid recirculation pump 112. Similarly, the interior fluid supply tube 110 may comprise one or more splitters that direct some of the fluid 150 to the supply tube connector 104 and some of the fluid to one or more alternate supply tube connectors.

According to certain embodiments, the invention of the present application is powered by plugging in the device 100 by using a power cord associated with the device 100 and connecting the power cord to a power source, such as an outlet. In other embodiments, the invention of the present application is battery-operated. In this way, the device is not tethered to a stationary or limited range power source. In some embodiments, wherein the device of the present application is battery-operated or otherwise using a non-limited range or non-stationary power source, the device may be portable. In this way, a user may easily transport and use the device 100. In the embodiments wherein the device 100 is portable, the device may easily be attached or tethered to a user device, such as a wheel chair, wheel chair, or other user device.

Figure 2:
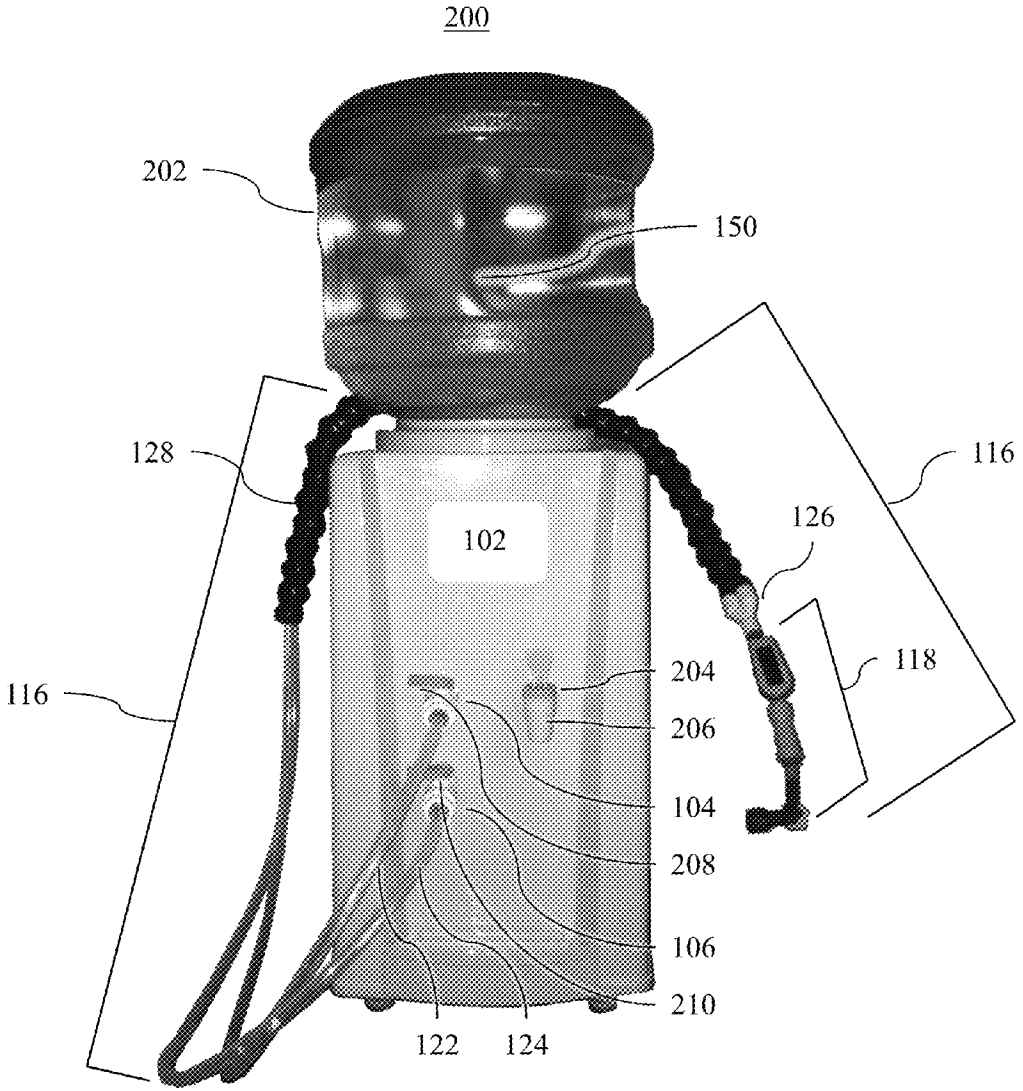
FIG. 2 provides an exterior view of an device for providing personal hydration, according to an embodiment of the present invention.

FIG. 2 depicts an external view of the device 100 as an exemplary embodiment of the present invention. A fluid source container 202 is positioned atop the device case 102 such that the fluid 150 may be delivered to the device 100. The device case 102 is comprised of two supply tube connectors 104 and 204, and one return tube connector 106. A spigot with a handle 206 is operatively connected to supply tube connector 204. Shut-off valves 208, 210 are operatively connected to both the supply tube connector 104 and return tube connector 106 such that the flow of the fluid 150 may be terminated when the fluid supply and return tubes are disconnected from the device case.

While the foregoing disclosure discusses illustrative embodiments, it should be noted that various changes and modifications could be made herein without departing from the scope of the described aspects and/or embodiments as defined by the appended claims. Furthermore, although elements of the described aspects and/or embodiments may be described or claimed in the singular, the plural is contemplated unless limitation to the singular is explicitly stated. Additionally, all or a portion of any embodiment may be utilized with all or a portion of any other embodiment, unless stated otherwise.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

The invention claimed is:

1. A device configured to provide a source of hands-free hydration, the device comprising: the chilled fluid tank to hold the chilled fluid delivered to the user;

a fluid supply tube connected to the interior of the chilled fluid tank via the supply tube connector;

a fluid return tube connected to the interior of the chilled fluid tank via the return tube connector;

a recirculation pump operatively connected with the fluid supply tube, the recirculation pump configured to pump fluid through the supply tube away from the chilled fluid tank and into the fluid supply tube;

a drinking valve;

a "Y" connector configured to connect the fluid supply tube and the fluid return tube to the drinking valve;

a check valve positioned between the "Y" connector and the drinking valve:

the drinking valve configured to automatically deliver cooled fluid to a user when the drinking valve is depressed with the mouth of the user;

a tube sleeve encasing both the fluid supply tube and the fluid return tube, the tube sleeve being semi-rigid and adjustable to any position relative to the user;

the fluid supply tube connected to the interior of the chilled fluid tank via the supply tube connector and the fluid return tube connected to the interior of the chilled fluid tank via the return tube connector are characterized in that the fluid is automatically circulated to and from the chilled fluid tank, keeping the fluid continuously cooled.

2. The device of claim 1, wherein the chilled fluid tank contains a fluid cooling element.

3. The device of claim 1, wherein the check valve is positioned between the "Y" connector and the drinking valve to prevent the fluid from flowing backward into the return tube.

4. The device of claim 1, wherein a replaceable fluid container located outside of the device provides a source of the fluid to be stored in the chilled fluid tank located inside the device.

* * * * *